US008038507B2

(12) United States Patent
Obayashi

(10) Patent No.: US 8,038,507 B2
(45) Date of Patent: Oct. 18, 2011

(54) EYEGLASS LENS PROCESSING APPARATUS

(75) Inventor: Hirokatsu Obayashi, Toyokawa (JP)

(73) Assignee: Nidek Co., Ltd., Gamagori-Shi (JP)

( * ) Notice: Subject to any disclaimer, the term of this patent is extended or adjusted under 35 U.S.C. 154(b) by 396 days.

(21) Appl. No.: 12/414,295

(22) Filed: Mar. 30, 2009

(65) Prior Publication Data

US 2009/0247051 A1 Oct. 1, 2009

(30) Foreign Application Priority Data

Mar. 31, 2008 (JP) ..... 2008-094102

(51) Int. Cl.
*B24B 49/02* (2006.01)
*B24B 9/14* (2006.01)

(52) U.S. Cl. ..... 451/5; 451/8; 451/43

(58) Field of Classification Search ..... 451/5, 8, 451/42–44, 255
See application file for complete search history.

(56) References Cited

U.S. PATENT DOCUMENTS

| | | | | |
|---|---|---|---|---|
| 5,333,412 | A | 8/1994 | Matsuyama | |
| 6,089,957 | A | 7/2000 | Shibata | |
| 6,095,896 | A | 8/2000 | Kobayashi | |
| 6,588,898 | B2 | 7/2003 | Iwai et al. | |
| 6,790,124 | B2 | 9/2004 | Shibata | |
| 7,322,082 | B2 | 1/2008 | Natsume et al. | |
| 7,476,143 | B2 * | 1/2009 | Shibata | 451/5 |
| 7,510,459 | B2 * | 3/2009 | Yamamoto | 451/6 |
| 7,731,565 | B2 * | 6/2010 | Shibata et al. | 451/5 |
| 2007/0298686 | A1 * | 12/2007 | Shibata | 451/5 |
| 2008/0248722 | A1 * | 10/2008 | Takeichi | 451/5 |

FOREIGN PATENT DOCUMENTS

| | | | |
|---|---|---|---|
| JP | 4-93164 | A | 3/1992 |
| JP | 11-70451 | A | 3/1999 |
| JP | 2001-47309 | A | 2/2001 |
| JP | 2001-287144 | A | 10/2001 |
| JP | 2003-145328 | A | 5/2003 |
| JP | 2006-142473 | A | 6/2006 |
| JP | 2006-281367 | A | 10/2006 |

OTHER PUBLICATIONS

European Search Report dated Jul. 17, 2009.

* cited by examiner

*Primary Examiner* — Dung Van Nguyen
(74) *Attorney, Agent, or Firm* — Sughrue Mion, PLLC

(57) ABSTRACT

An eyeglass lens processing apparatus includes: an edge position detector which detects front and rear edge positions of an eyeglass lens based on target lens shape data; a bevel locus setting unit which includes: a) a provisional bevel locus calculator which obtains a provisional bevel locus by obtaining a bevel curve substantially equal to a frame curve; b) a nose-side bevel position determining unit which determines a corrected bevel apex position at a nose-side edge position; c) an ear-side bevel position determining unit which determines a corrected bevel apex position at an ear-side edge position; and d) a corrected bevel locus calculator which obtains a corrected bevel locus which has a curve value equal to the bevel curve; and a processing controller which obtains beveling information based on the corrected bevel locus and controls an operation of the apparatus according to the beveling data.

5 Claims, 8 Drawing Sheets

EYEGLASS LENS PROCESSING APPARATUS

BACKGROUND OF THE INVENTION

The present invention relates to an eyeglass lens processing apparatus for processing a bevel in a peripheral edge of an eyeglass lens.

As a method of setting a bevel formed in the peripheral edge of an eyeglass lens, there are known a front curve based method of forming a bevel along a front curve of a lens and a method of dividing a thickness of the lens edge at a predetermined ratio in correspondence to a lens shape. In addition, there is known a method of tilting a bevel locus formed by a bevel apex formed in the edge surface of the lens (U.S. Pat. No. 6,095,896, U.S. Pat. No. 6,588,898, and JP-A-2006-142473).

Incidentally, in recent years, a high curve frame having a large curve degree has been required to be used in accordance with various designs. However, the known bevel setting method is not suitable for the high curve frame. That is, since a tilt angle of the frame is not considered in the known bevel setting method, a bevel slope on the side of a lens front surface or a bevel slope on the side of a lens rear surface appears to be large, and thus the eyeglass lens has a poor appearance. In addition, since the known method of tilting the bevel locus aims to adjust the excessive portion of the lens edge on the front side or the rear side of the lens frame, it is not possible to appropriately form the bevel having a good appearance in consideration of the tilt state of the high curve frame and it takes trouble to form the bevel.

SUMMARY OF THE INVENTION

A technical object of the present invention is to provide an eyeglass lens processing apparatus capable of easily forming a bevel having a good appearance upon fitting an eyeglass lens into a lens frame having a high curve frame.

In order to achieve the above-described object, the present invention adopts the following configuration.

(1) An eyeglass lens processing apparatus for beveling a peripheral edge of an eyeglass lens by a beveling tool, the eyeglass lens processing apparatus comprising:

an edge position detector which detects a front edge position and a rear edge position of the lens on the basis of a target lens shape;

a mode selector which shifts a processing mode to a high curve processing mode for a high curve frame;

a bevel locus setting unit which includes:

a) a provisional bevel locus calculator which obtains a provisional bevel locus by obtaining a bevel curve substantially equal to a curve along the frame or a curve along a front surface of the lens when the high curve processing mode is selected;

b) a nose-side bevel position determining unit which determines a corrected bevel apex position at a nose-side edge position of the lens by setting a width of a front bevel slope, or obtaining a nose-side bevel apex position in which the width of the front bevel slope is substantially equal to or smaller than a width of a rear bevel slope;

c) an ear-side bevel position determining unit which determines a corrected bevel apex position at an ear-side edge position of the lens by setting a position in which an ear-side bevel apex position on the provisional bevel locus is shifted to a rear surface of the lens, or obtaining a position in which a predetermined positional relationship between the ear-side bevel apex position and the nose-side corrected bevel apex position is satisfied; and d) a corrected bevel locus calculator which obtains a corrected bevel locus which has a curve value equal to a value of the bevel curve and passes through the nose-side corrected bevel apex position and the ear-side corrected bevel apex position; and a controller which obtains beveling data based on the corrected bevel locus and controls an operation of the apparatus according to the beveling data.

(2) The eyeglass lens processing apparatus according to (1), further comprising:

a tilt angle input unit which is used to input a tilt angle of the frame, wherein the nose-side bevel position determining unit determines the nose-side corrected bevel apex position at a position in which the width of the front bevel slope is equal to a predetermined value smaller than the width of the rear bevel slope, a position in which the width of the front bevel slope is smaller by a predetermined ratio than the width of the rear bevel slope, or a position in which the width of the front bevel slope is substantially equal to the width of the rear bevel slope when the frame is viewed from the front side thereof on the basis of the input tilt angle and the edge position.

(3) The eyeglass lens processing apparatus according to (1), wherein the ear-side bevel position determining unit determines the ear-side corrected bevel apex position by a method which shifts the ear-side bevel apex position on the provisional bevel locus to the rear surface by a fixed amount, a method which shifts the ear-side bevel apex position on the provisional bevel locus to the rear surface in accordance with a distance in which the nose-side corrected bevel apex position changes relative to the nose-side bevel apex position on the provisional bevel locus, a method which shifts the ear-side bevel apex position on the provisional bevel locus to a position obtained by dividing an edge thickness at the ear-side edge position at a predetermined ratio, or a method which shifts the ear-side bevel apex position on the provisional bevel locus to the rear surface by an input amount.

(4) The eyeglass lens processing apparatus according to (1), further comprising:

a tilt angle input unit which is used to input a tilt angle of the frame, wherein the ear-side bevel position determines unit determines the ear-side corrected bevel apex position by a method which shifts the bevel apex position on the provisional bevel lens to the rear surface in accordance with the input tilt angle, or a method which shifts the ear-side bevel apex position on the provisional bevel locus to a position in which the width of the front bevel slope is substantially equal to the width of the rear bevel slope when the frame is viewed from the front side thereof on the basis of the input tilt angle.

(5) The eyeglass lens processing apparatus according to (1), wherein the ear-side bevel position determines unit determines the ear-side edge position used to determine the ear-side corrected bevel apex position at a position which is located on a horizontal line passing through a geometric center of the target lens shape, at a position which is opposite to the edge position having the nose-side corrected bevel apex position by 180° about a lens chuck center, or at a position which is opposite to the edge position having the nose-side corrected bevel apex position by 180° about a perpendicular line passing through the geometric center of the target lens shape.

DETAILED DESCRIPTION OF PREFERRED EMBODIMENTS

Figure 1:
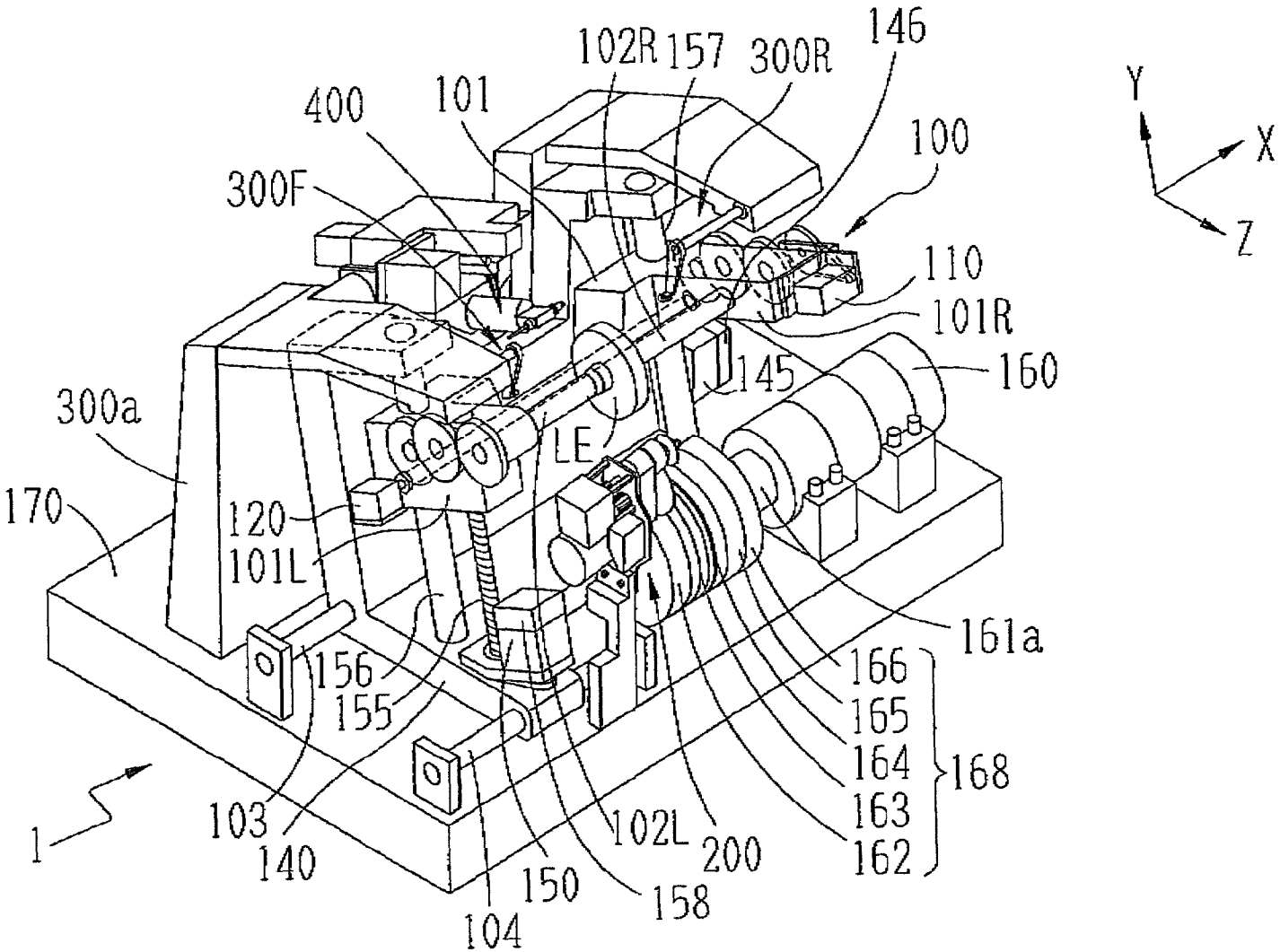
FIG. 1 is a schematic configuration diagram showing a processing part of an eyeglass lens processing apparatus.

Hereinafter, an embodiment of the invention will be described with reference to the accompanying drawings. FIG. 1 is a schematic configuration diagram showing a processing part of an eyeglass lens processing apparatus according to the invention.

A carriage unit 100 is mounted onto a base 170 of a processing apparatus body 1. Then, a peripheral edge of a processing lens LE held (chucked) between lens chuck shafts (lens rotary shafts) 102L and 102R of a carriage 101 is processed by a grindstone group 168 coaxially attached to a grindstone spindle 161*a* in a press-contact state. The grindstone group 168 includes a roughing grindstone 162 for glass, a high curve bevel-finishing grindstone 163 having a bevel slope forming a bevel in a high curve lens, a finishing grindstone 164 having a V-groove (bevel groove) VG forming a bevel in a low curve lens and a plane processing surface, a flat-polishing grindstone 165, and a roughing grindstone 166 for plastic. The grindstone spindle 161*a* is rotated by a motor 160.

The lens chuck shaft 102L and the lens chuck shaft 102R are coaxially supported to a left arm 101L and a right arm 101R of the carriage 101, respectively, so as to be rotatable. The lens chuck shaft 102R is moved to the lens chuck shaft 102L by a motor 110 attached to the right arm 101R. Then, the lens LE is held by the two lens chuck shafts 102R and 102L. Additionally, the two lens chuck shafts 102R and 102L are rotated in a synchronized manner by a motor 120, attached to the left arm 101L, via a rotary transmission mechanism such as a gear. Accordingly, a lens rotary unit is configured in this manner.

The carriage 101 is mounted onto an X-axis moving support base 140 capable of moving in an X-axis direction along shafts 103 and 104 extending in parallel to the lens chuck shafts 102R, 102L and the grindstone spindle 161*a*. A ball screw (not shown) extending in parallel to the shaft 103 is attached to the rear portion of the support base 140, and the ball screw is attached to a rotary shaft of an X-axis movement motor 145. By means of a rotation of the motor 145, the carriage 101 is linearly moved in an X-axis direction (an axial direction of the lens chuck shaft) together with the support base 140. Accordingly, an X-axis movement unit is configured in this manner. A rotary shaft of the motor 145 is provided with an encoder 146 as a detector for detecting a movement of the carriage 101 in an X-axis direction.

Additionally, shafts 156 and 157 extending in a Y-axis direction (a direction in which a distance between the shaft of the lens chuck shafts 102R, 102L and the shaft of the grindstone spindle 161*a* changes) are fixed to the support base 140. The carriage 101 is mounted onto the support base 140 so as to be movable in a Y-axis direction along the shafts 156 and 157. A Y-axis movement motor 150 is fixed to the support base 140. A rotation of the motor 150 is transmitted to a ball screw 155 extending in a Y-axis direction, and the carriage 101 is moved in a Y-axis direction by a rotation of the ball screw 155. Accordingly, a Y-axis movement unit is configured in this manner. A rotary shaft of the motor 150 is provided with an encoder 158 as a detector for detecting a movement of the carriage 101 in a Y-axis direction.

In FIG. 1, a chamfering mechanism 200 is disposed on the front side of the apparatus body. The description of the chamfering mechanism 200, which is well known, will be omitted (for example, see JP-A-2006-239782).

Figure 2:
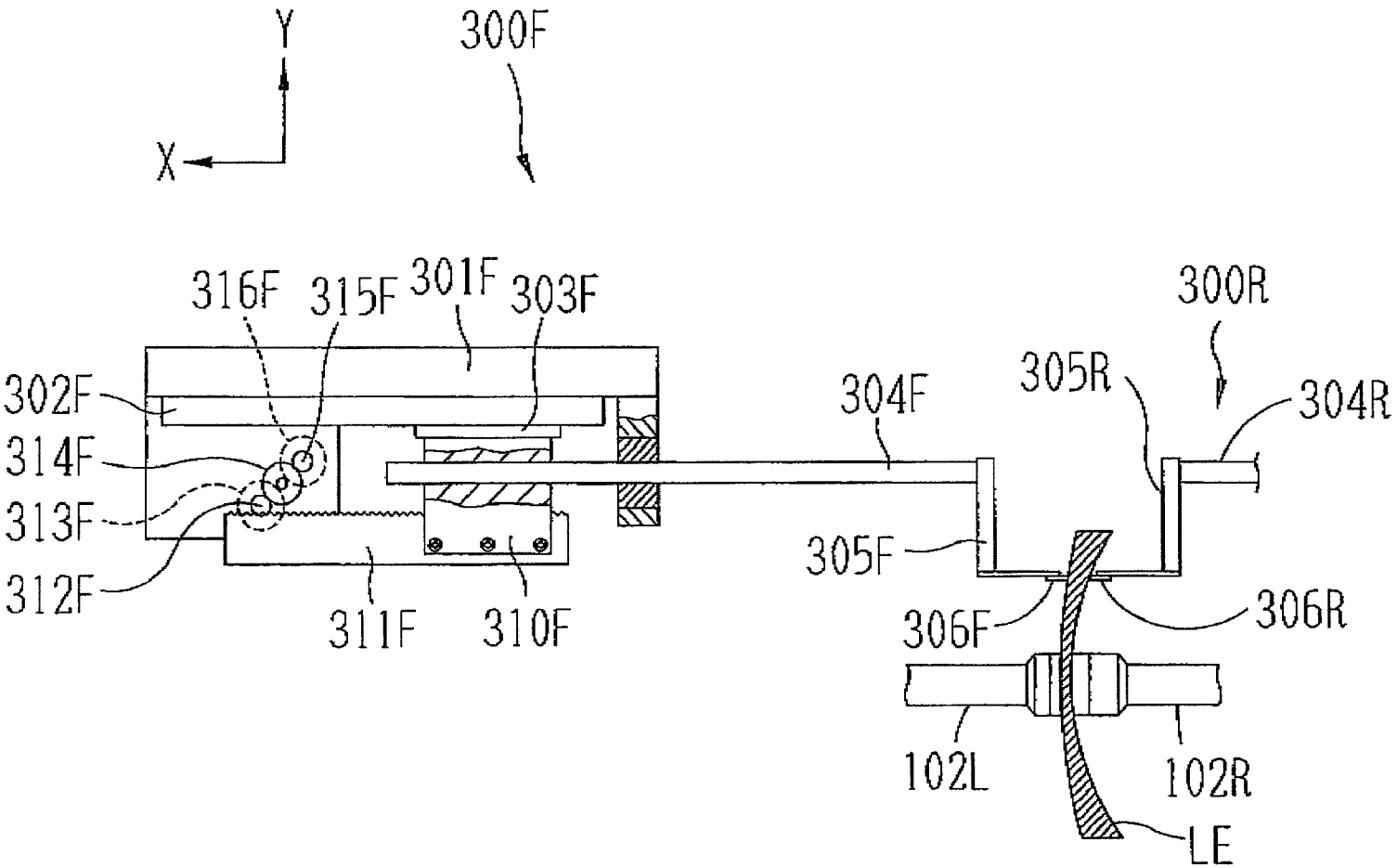
FIG. 2 is a schematic configuration diagram showing a lens edge position measuring unit.

In FIG. 1, lens edge position measuring units (edge position detecting units) 300F and 300R are provided above the carriage 101. FIG. 2 is a schematic diagram showing the measuring unit 300F for measuring a lens edge position of a front surface of the lens. An attachment support base 301F is fixed to a support base block 300*a* fixed to a base 170 shown in FIG. 1, and a slider 303F is slidably attached to a rail 302F fixed to the attachment support base 301F. A slide base 310F is fixed to the slider 303F, and a measuring arm 304F is fixed to the slide base 310F. An L-shape hand 305F is fixed to a front end portion of the measuring arm 304F, and a measuring portion 306F is fixed to a front end portion of the hand 305F. The measuring portion 306F makes contact with a front-side refractive surface of the lens LE.

A rack 311F is fixed to a lower end portion of the slide base 310F. The rack 311F meshes with a pinion 312F of an encoder 313F fixed to the attachment support base 301E Additionally, a rotation of a motor 316F is transmitted to the rack 311F via a gear 315F, an idle gear 314F, and the pinion 312F, thereby moving the slide base 310F in an X-axis direction. During the measurement of the lens edge position, the motor 316F presses the measuring portion 306F against the lens LE at the fixed force all the time. The pressing force of the measuring portion 306F applied from the motor 316F to the lens refractive surface is set to a small force in order to prevent a defect of the lens refractive surface. As means for applying a pressing force of the measuring portion 306F against the lens refractive surface, pressure applying means such as a spring may be employed. The encoder 313F detects the movement position of the measuring portion 306F in an X-axis direction by detecting the movement position of the slide base 310F. On the basis of the movement position information, the rotary angle information of the lens chuck shafts 102L, 102R, and the Y-axis movement information, the edge position of the front surface of the lens LE (and the lens front-surface position) is measured.

Since a configuration of the measuring unit 300R for measuring the edge position of a rear surface of the lens LE is bisymmetric to the configuration of the measuring unit 300F, "F" of the reference numerals given to the components of the measuring unit 300F shown in FIG. 2 is changed to "R", and the description thereof will be omitted.

During the measurement of the lens edge position, the measuring portion 306F comes into contact with the front surface of the lens, and the measuring portion 306R comes into contact with the rear surface of the lens. When the carriage 101 is moved in a Y-axis direction and the lens LE is rotated on the basis of target lens shape data in this state, both edge positions of the front surface and the rear surface of the lens used for processing a peripheral edge of the lens are measured. Further, in the lens edge position measuring units having the measuring portion 306F configured to be movable in an X-axis direction together with the measuring portion 306R, the front surface and the rear surface of the lens are separately measured. Furthermore, in the above-described lens edge position measuring units, the lens chuck shafts 102L and 102R are configured to move in a Y-axis direction, but the measuring portions 306F and 306R may be configured to move in a Y-axis direction relative to the lens chuck shafts.

In FIG. 1, a drilling-grooving mechanism 400 is disposed on the rear side of the carriage unit 100. Since the carriage unit 100, the lens edge position measuring unit 300F, 300R, and the drilling-grooving mechanism 400 may have the basic configuration disclosed in JP-A-2003-145328 (U.S. Pat. No. 6,790,124), the detailed description thereof will be omitted.

In addition, in the configuration of the X-axis movement unit and the Y-axis movement unit of the eyeglass lens processing apparatus shown in FIG. 1, the grindstone spindle 161*a* may be configured to move in an X-axis direction and a Y-axis direction relative to the lens chuck shafts (102L and 102R). In the configuration of the lens edge position measuring units 300F and 300R, the measuring portions 306F and 306R may be configured to move in a Y-axis direction relative to the lens chuck shafts (102L and 102R).

Figure 3:
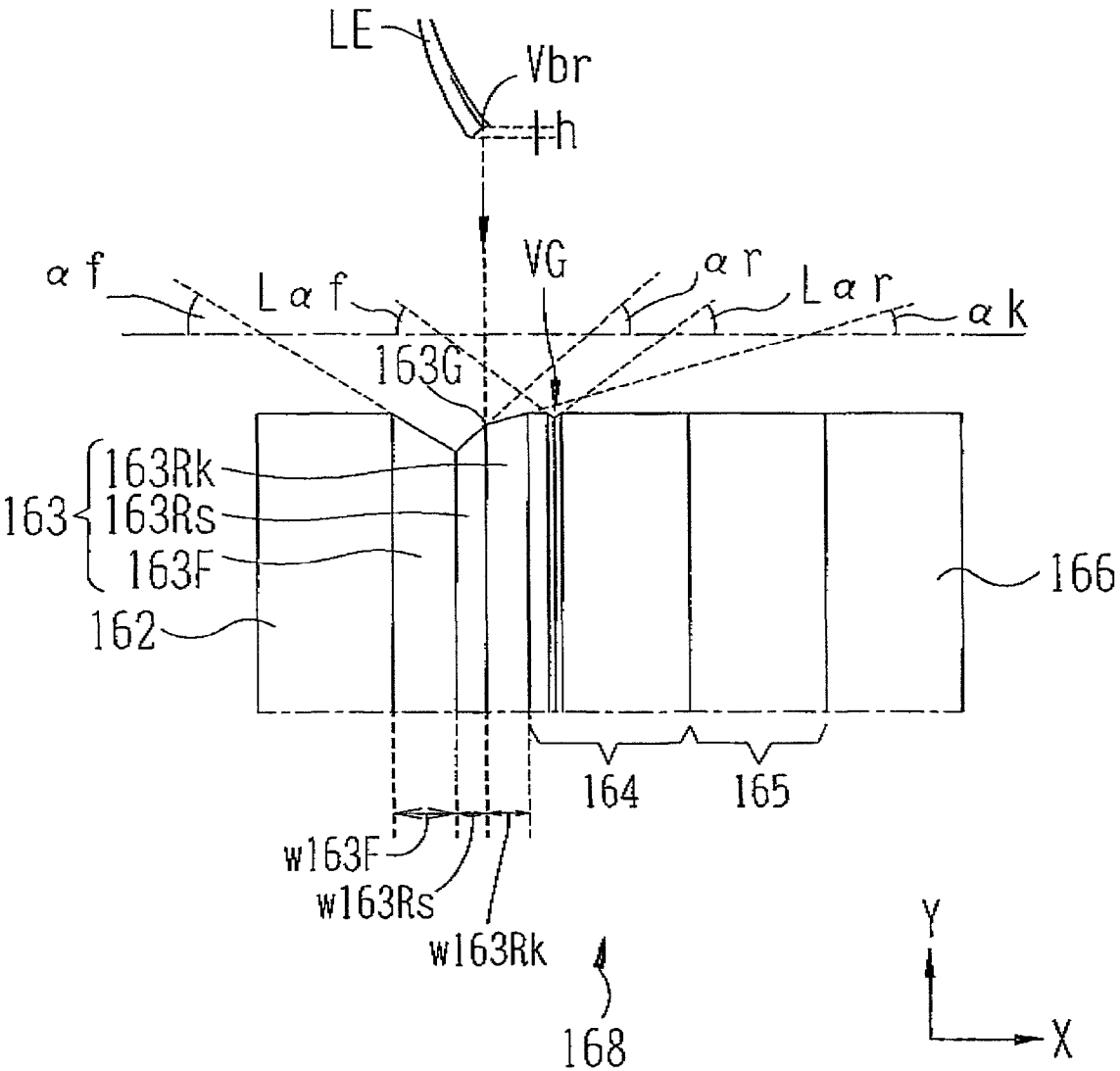
FIG. 3 is an explanatory diagram showing a configuration of a grindstone.

FIG. 3 is a diagram showing a configuration of the grindstone group 168. Regarding the beveling V-groove of the low curve bevel-finishing grindstone 164, an angle Lαf of a front surface processing slope and an angle Lαr of a rear surface processing slope with respect to an X-axis direction are set to 35° in order to have a good appearance when a lens having a gentle frame curve is fitted into an eyeglass frame. In addition, a depth of the V-groove VG is less than 1 mm.

The high curve bevel-finishing grindstone 163 includes a front surface beveling grindstone 163F for processing the bevel slope on the side of the front surface of the lens LE; a rear surface beveling grindstone 163Rs for processing the bevel slope on the side of the rear surface of the lens LE; and a rear-surface-bevel shoulder processing slope 163Rk for forming a bevel shoulder on the side of the rear surface of the lens. These grindstones incorporated into the eyeglass lens processing apparatus may be separately provided.

An angle of of the beveling slope of the front surface beveling grindstone 163F with respect to an X-axis direction is gentler than the angle Lαf of the front surface processing slope of the finishing grindstone 164, where the angle αf is, for example, 30°. On the other hand, an angle αr of the beveling slope of the rear surface beveling grindstone 163Rs with respect to an X-axis direction is larger than the angle Lαr of the rear surface processing slope of the finishing grindstone 164, where the angle αr is, for example, 45°. In addition, an angle αk of the rear-surface-bevel shoulder processing slope 163Rk with respect to an X-axis direction is larger than the angle of the rear-surface-bevel shoulder processing slope of the finishing grindstone 164 (in FIG. 3, the angle is 0°, but may be 3° or less), where the angle αk is, for example, 15°. Accordingly, when the lens is attached to the high curve frame, it is possible to obtain a good appearance and to easily hold the lens.

In addition, a width w163F of the front surface beveling grindstone 163F is set to 9 mm in an X-axis direction, and a width 163Rs of the rear surface beveling grindstone 163Rs is set to 3.5 mm. Since the bevel slope on the side of the front surface and the bevel slope on the side of the rear surface are separately processed in the case of the high curve lens, the width w163F and the width 163Rs are set to be larger than that of the low curve finishing grindstone 164 so as to prevent the interference upon processing the bevel slopes on the side of the front surface and the rear surface of the lens. A width wl63Rk of the rear-surface-bevel shoulder processing slope 163Rk is set to 4.5 mm. In addition, as a beveling tool for processing a bevel, the grindstone is used in this embodiment, but a cutter may be used.

Figure 4:
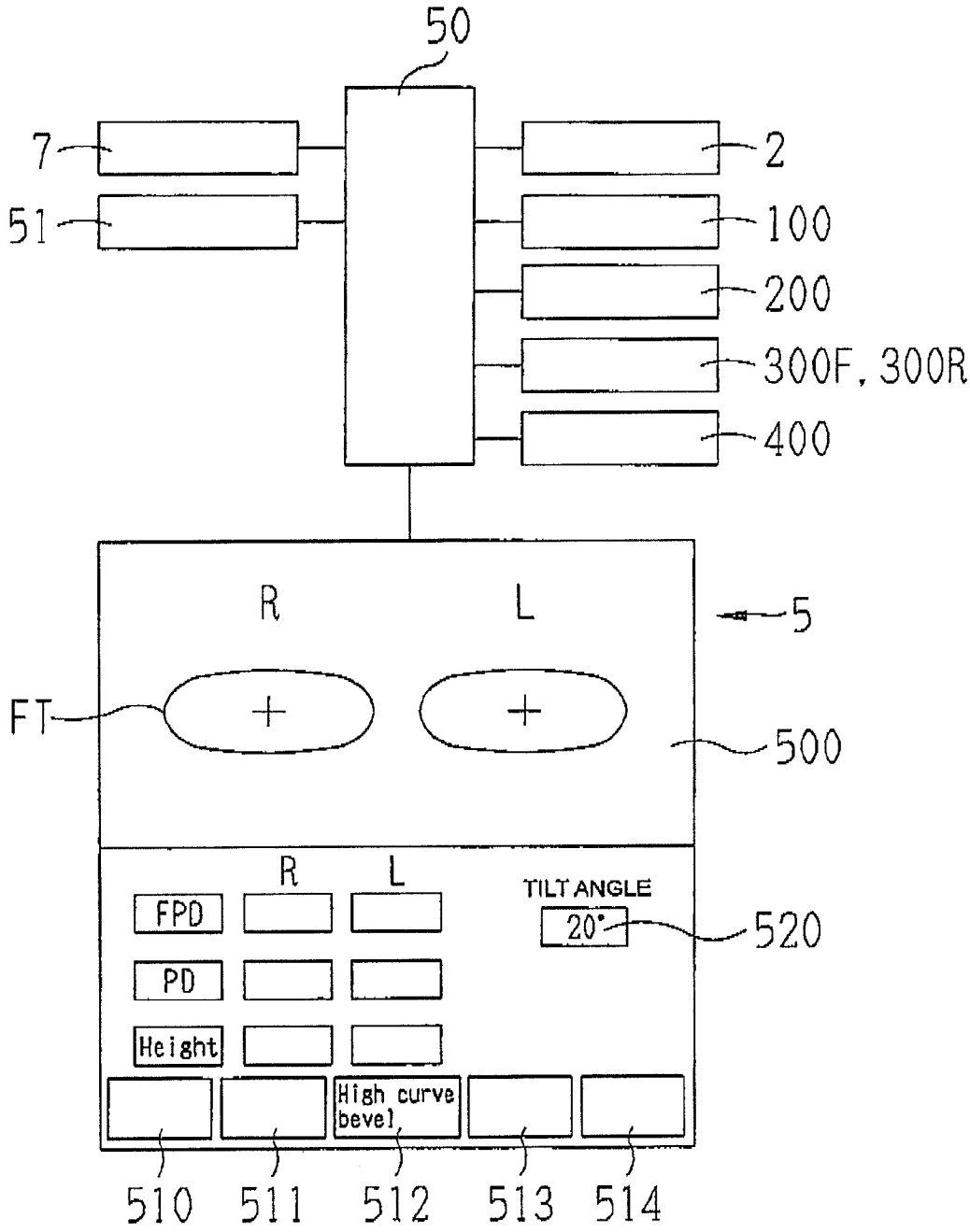
FIG. 4 is a control block diagram showing the eyeglass lens processing apparatus.

FIG. 4 is a control block diagram showing the eyeglass lens processing apparatus. A control unit 50 is connected to an eyeglass frame shape measuring unit 2 (such as a unit disclosed in JP-A-H04-93164 (U.S. Pat. No. 5,333,412)), a touch-panel type display 5 as input means and display means, a switch unit 7, a memory 51, the carriage unit 100, the chamfering mechanism 200, the lens edge position measuring units 300F, 300R, the drilling-grooving mechanism 400, and the like. An input signal input to the eyeglass lens processing apparatus can be generated by touching the display 5 with a touch pen (or a finger). The control unit 50 receives an input signal by means of a touch panel function of the display 5, and controls a display of information and a figure of the display 5.

A bevel locus setting operation suitable for the high curve frame in the eyeglass lens processing apparatus having the above-described configuration will be mainly described.

The three-dimensional shapes of the left and right lens frames are measured by the eyeglass frame shape measuring unit 2. The target lens shape data (rn and θn) (n=1, 2, . . . N) of the lens frame measured by the eyeglass frame shape measuring unit 2 is input so as to be stored in the memory 51 by pressing the switches of the switch unit 7. Here, "rn" denotes the radial length data and "θn" denotes the radial angle data. The target lens shape FT is displayed on a screen 500 of the display 5. Then, it becomes a state where the layout data can be inputted, such as a PD (pupillary distance) value of a wearer, a FPD (frame pupillary distance) value of the eyeglass frame, and a height of an optical center relative to a geometric center of the target lens shape. The layout data can be input by manipulating a predetermined button key displayed on the display 5. The processing conditions such as a material of the lens, a type of the frame, a processing mode (beveling, flat-processing), a chamfering, and a chuck center (an optical center chuck and a frame center chuck) of the lens can be set by manipulating predetermined button keys 510, 511, 512, 513, and 514 displayed on the display 5. Here, in order to handle the high curve frame, the high curve mode is selected by the button key 512. When the high curve mode is selected, the high curve bevel-finishing grindstone (hereinafter, a high curve beveling grindstone) 163 is selected and used for the beveling process. The chuck center of the lens is selected as the frame center (the geometric center of the target lens shape). In addition, in the case of the high curve frame, a high curve lens is used as the lens LE. In the case of the high curve mode, a bevel height h (in FIG. 3, a distance from a bevel apex to a bevel bottom Vbr) may be arbitrarily set, and an input box 540 of the bevel simulation screen described later (see FIG. 9) may be used.

In addition, in the case where the left and right lens frames having a high curve frame are traced by the eyeglass frame shape measuring unit 2, a tilt angle β of the frame is input together with the target lens shape data, and a value of the angle β is displayed in a frame tilt angle input box 520. In the case where the frame shape cannot be measured by the eyeglass frame shape measuring unit 2, the tilt angle β of the frame may be measured by eyes on the basis of a graph paper, and may be input to the input box 520.

Figure 5A:
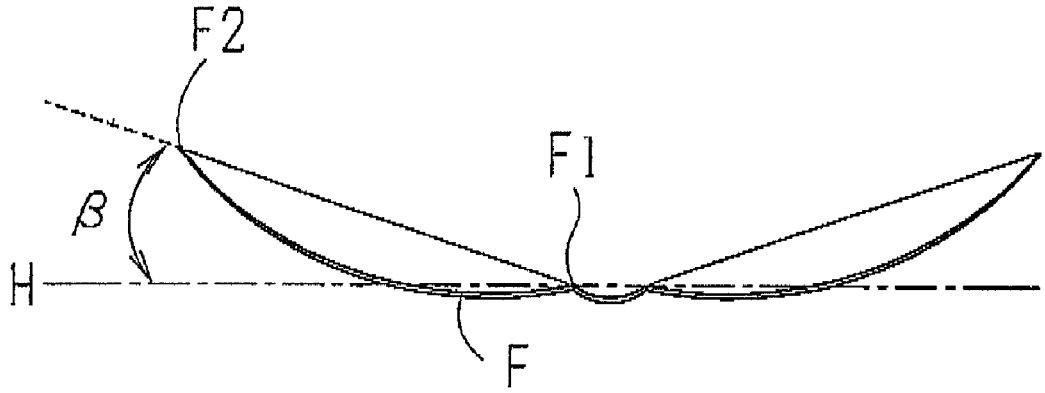
FIG. 5A is an explanatory diagram showing a tilt angle of the frame.
Figure 5B:
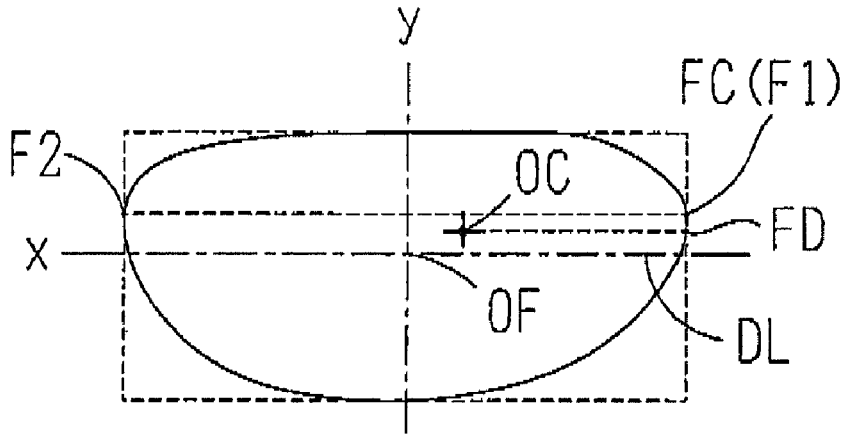
FIG. 5B is an explanatory diagram showing a bevel apex position at an edge position and a datum line of a target lens shape.

Here, as shown in FIG. 5A, the tilt angle β of the frame is set to an angle formed between a line connecting a point F1 closest to a nose and a point F2 closest to an ear of the target lens shape of the lens frame F when a wearer wears the eyeglass frame and a horizontal direction H (a direction connecting two points closest to the nose of the left and right lens frames) when the wearer wears the eyeglass frame. In addition, the points F1 and F2 used for determining the tilt angle β of the frame may be obtained by a method of determining the two points on the basis of the points on a datum line DL (a line passing through a geometric center OF of the target lens shape in an X-axis direction) of the target lens shape in FIG. 5B or a method of determining the two points on the basis of a nose-side rearmost point and an ear-side rearmost point when the wearer wearing the eyeglass frame is viewed from the upside.

When the data required for the processing is available, an operator chucks the lens LE in the lens chuck shafts 102R and 102L, and operates the eyeglass lens processing apparatus by pressing a start switch of the switch unit 7. The control unit 50 operates the lens shape measuring units 300F and 300R on the basis of a start signal, and obtains an edge position measurement result corresponding to the radial angle of the target lens shape of the front surface and the rear surface of the lens on the basis of the target lens shape data. At this time, the control unit 50 carriers out the lens shape measuring operation twice in order to approximately obtain the slope angles in the vicinity of the edge positions of the front and rear surfaces of the lens, where during the lens shape measuring operation, a first measurement locus of the radial length of the target lens shape and a second measurement locus located on the outside of the first measurement locus by a predetermined amount (for example, 0.5 mm) are measured. When the edge position information is obtained, the control unit 50 calculates a bevel apex locus on the basis of the edge position information.

Figure 6:
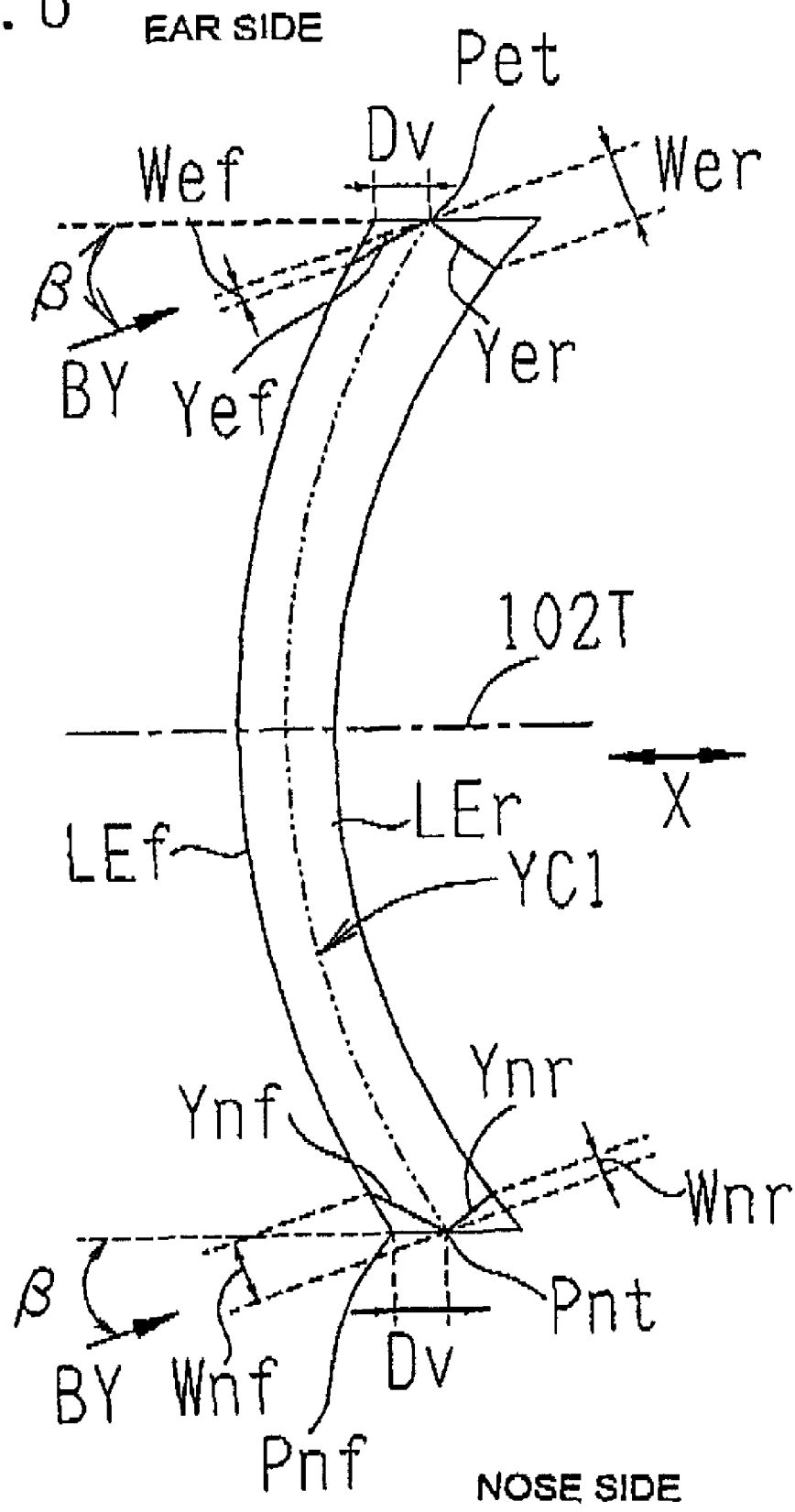
FIG. 6 is an explanatory diagram showing a setting operation of a bevel apex position of an initially set bevel locus.

The bevel locus calculation will be described. FIGS. 6 and 7 are diagrams showing a state where the bevel apex is set in the radial angle (edge position) of the desired target lens shape of a right eye lens. In FIGS. 6 and 7, the nose-side bevel position and the ear-side bevel position are set on the datum line DL.

FIG. 6 is an example showing a first bevel locus which is initially set on the basis of the edge position data corresponding to the radial angle of the target lens shape. A bevel locus YC1 (provisional bevel locus) has, for example, a bevel curve along a front surface curve of the lens or a bevel curve substantially equal to the frame curve so as to be suitable for the high curve frame, and is automatically set so as to pass through a position of a half of a portion having the thinnest edge thickness. Alternatively, the bevel locus YC1 is set so as to pass through a position shifted from a lens front surface LEf by a predetermined amount.

The reference numeral 102T denotes an axis of the lens chuck shaft, and a direction of the lens chuck shaft is set to an X-axis direction. An arrow BY relative to an X-axis direction indicates a direction when viewed from the front surface of the lens LE in the state where the wearer wears the eyeglass frame, and an angle formed between an X-axis direction and the direction of the arrow BY is set to the tilt angle β of the frame. In addition, in FIG. 6, when a nose-side rear bevel slope Ynr (on the side of the lens rear surface) and a nose-side front bevel slope Ynf (on the side of the lens front surface) are viewed in a direction of the arrow BY, the widths thereof are denoted by Wnf and Wnr, respectively. When an ear-side rear bevel slope Yer (on the side of the lens rear surface) and an ear-side front bevel slope Yef (on the side of the lens front surface) are viewed in a direction of the arrow BY, the widths thereof are denoted by Wef and Wer, respectively. In the case where the bevel shoulder is formed by the rear-surface-bevel shoulder processing slope 163Rk, the rear bevel slopes Ynr and the front bevel slope Yer are regarded as a portion except for the bevel shoulder.

Here, in the high curve frame having the large tilt angle β, when a distance Dv from the edge position of the lens front surface to a bevel apex position Pnt is set to a large value, the width Wnf of the nose-side front bevel slope (on the side of the lens front surface) appears to be larger than the width Wnr of the nose-side rear bevel slope (on the side of the lens rear surface). On the contrary, the width Wer of the ear-side rear bevel slope (on the side of the lens rear surface) appears to be larger than the width Wef of the ear-side front bevel slope (on the side of the lens front surface).

Figure 7A:
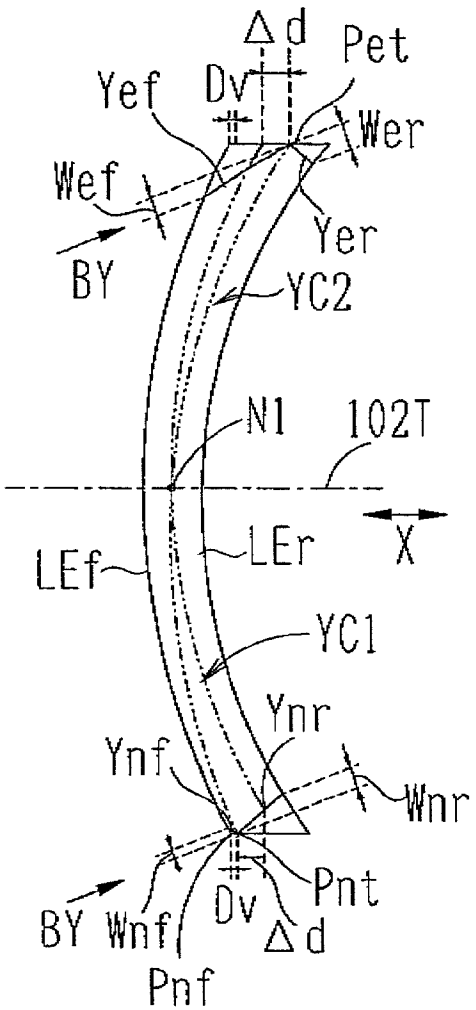
FIG. 7A is an explanatory diagram showing a setting operation of a corrected bevel apex position at an edge position and a tilting operation of a bevel curve.
Figure 7B:
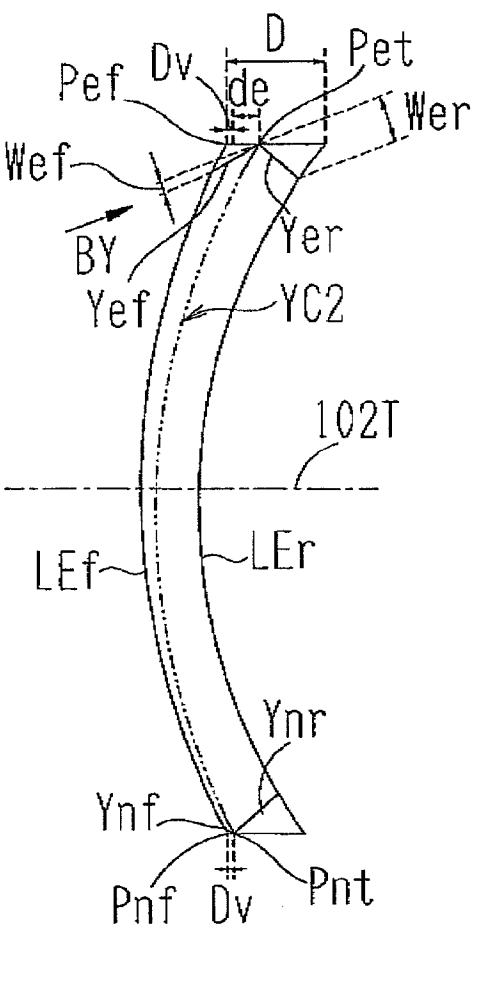
FIG. 7B is an explanatory diagram showing a setting operation of a corrected bevel apex position at an edge position and a tilting operation of a bevel curve.
Figure 7C:
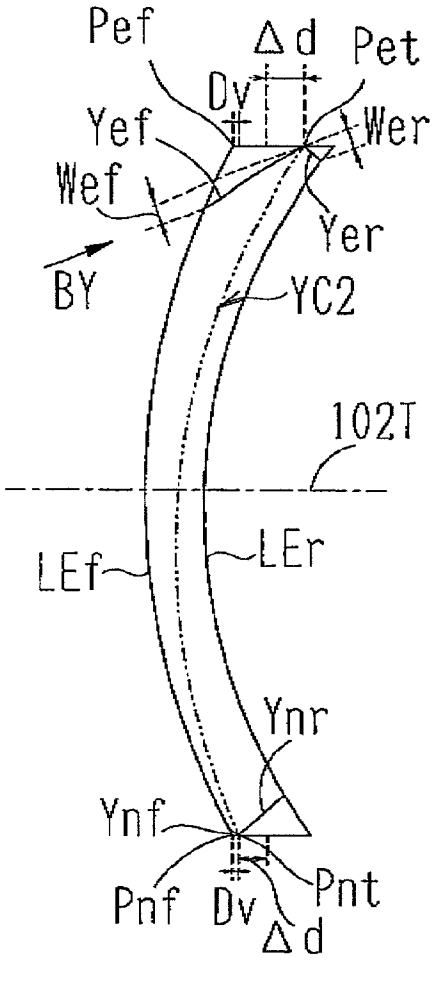
FIG. 7C is an explanatory diagram showing a setting operation of a corrected bevel apex position at an edge position and a tilting operation of a bevel curve.

For this reason, in order to obtain a good appearance of the widths Wnf and Wnr of the bevel slopes when viewed from the front side of the eyeglass frame, as shown in FIGS. 7A, 7B and 7C, a bevel locus YC2 (corrected bevel locus) is set in such a manner that the nose-side bevel apex position Pnt is shifted toward the lens front surface and the ear-side bevel apex position Pet is shifted toward the lens rear surface on the basis of the tilt angle β of the frame, the angle of of the front surface beveling grindstone 163F, the angle αr of the rear surface beveling grindstone 163Rs, and the like. At this time, the new bevel locus YC2 can be set in such a manner that the bevel curve of the bevel locus YC1 is inclined so as to pass through the shifted bevel apex positions Pnt and Pet in the state where the curve of the bevel locus YC1 is maintained.

Next, a preferable method of setting the nose-side corrected bevel apex position Pnt in an edge direction based on the angle β as the frame tilt information will be described. A first method of setting the nose-side corrected bevel apex position Pnt is to allow the width Wnf of the front bevel slope Ynf and the width Wnr of the rear bevel slope Ynr when viewed in a direction of the arrow BY (when viewed from the front side) to be substantially equal to each other. The first setting method corresponds to a method in which both appearances of the bevel slopes of the lens front surface and the lens rear surface are weighed heavily.

Figure 8:
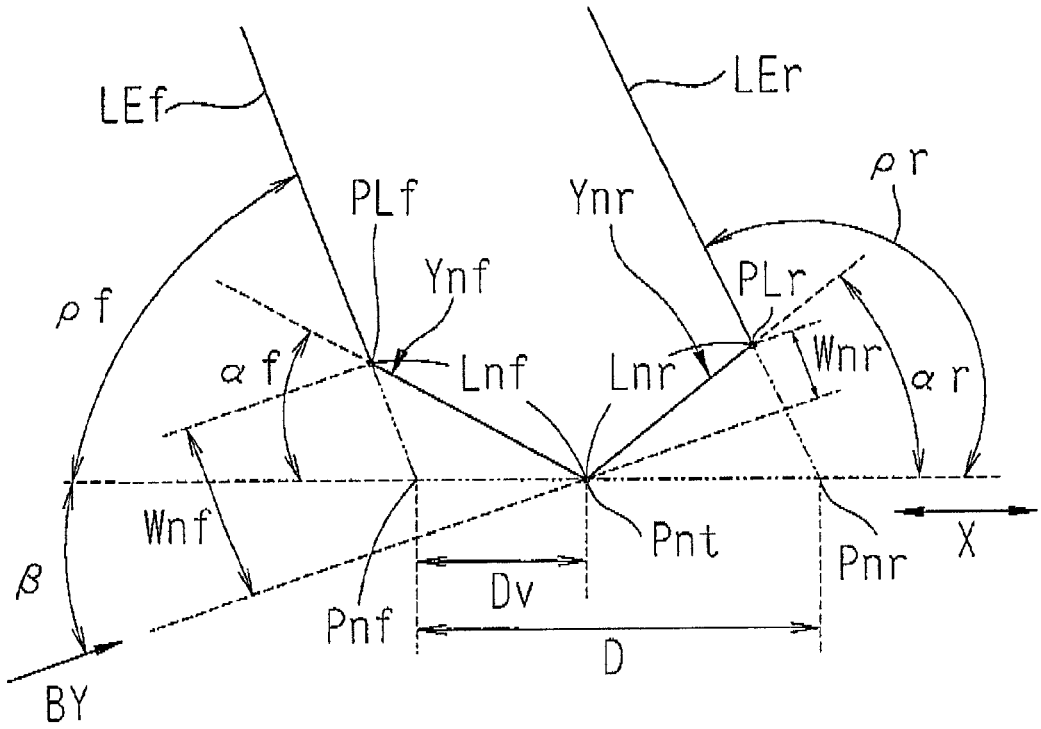
FIG. 8 is an enlarged diagram showing a nose-side lens portion in FIG. 6.

FIG. 8 is an enlarged diagram showing the nose-side lens portion in FIG. 6. In FIG. 8, an angle formed between the lens front surface LEf and a direction X of the lens chuck shaft is denoted by ρf, a position in which the front bevel slope Ynf intersects the lens front surface LEf is denoted by PLf, and a length of the front bevel slope Ynf (a distance from the Pnt to PLf) is denoted by Lnf. In addition, since the front bevel slope Ynf is processed by the front surface beveling grindstone 163F, an angle formed between the front bevel slope Ynf and a direction X of the lens chuck shaft is the angle αf of the front surface beveling grindstone 163F.

In the same manner, an angle formed between the lens rear surface LEr and a direction X of the lens chuck shaft is denoted by ρr, a position in which the rear bevel slope Ynr intersects the lens rear surface LEr is denoted by PLr, and a length of the rear bevel slope Ynr (a distance from the Pnt to PLr) is denoted by Lnr. The angle of the rear bevel slope Ynr is the angle αr of the rear surface beveling grindstone 163Rs.

In addition, since the slope angle ρf of the lens front surface is obtained by carrying out the lens edge position measuring operation twice so as to obtain the edge position Pnf of the lens front surface and a position located on the outside thereof by a predetermined amount, the slope angle ρf can be approximately obtained by using a line connecting the two points. The same applies to the slope angle ρr of the lens rear surface. In addition, when the curve of the lens front surface is known, it is possible to obtain the slope angle ρf in the vicinity of the edge position Pnf. When the curve of the lens rear surface is known, it is possible to obtain the slope angle ρr in the vicinity of the edge position Pnr. When the data related to the curves of the lens front surface and the lens rear surface is known in advance, the data may be input to the eyeglass lens processing apparatus. Alternatively, the slope angles can be obtained by carrying out the lens edge position measuring operation once. In addition, a distance from the edge position Pnf of the lens front surface and the edge position Pnr of the lens rear surface is denoted by D.

In FIG. 8, the width Wnf when the front bevel slope Ynf is viewed in a direction of the arrow BY (when viewed from the front side) can be obtained by the following equation on the basis of the tilt angle β of the frame.

$$Wnf=Lnf\cdot\sin(\alpha f+\beta) \qquad \text{Equation 1}$$

In consideration of the triangle formed by three points (PLf, Pnf, and Pnt), the length Lnf of the front bevel slope Ynf can be obtained by the following equation on the basis of the sine theorem in the state where the inside angle of the triangle and the distance Dv between the points Pnf and Pnt are obtained.

$$Lnf = \frac{Dv\cdot\sin(180-\rho f)}{\sin(\rho f-\alpha f)} \qquad \text{Equation 2}$$

In the same manner, the width Wnr when the rear bevel slope Ynr is viewed in a direction of the arrow BY (when viewed from the front side) can be obtained by the following equation.

$$Wnr=Lnr\cdot\sin(\alpha r-\beta) \qquad \text{Equation 3}$$

In consideration of the triangle formed by three points (PLr, Pnr, and Pnt), the length Lnr of the rear bevel slope Ynr can be obtained by the following equation on the basis of the sine theorem in the state where the inside angle of the triangle and the distance (D-Dv) between the points Pnr and Pnt are obtained.

$$Lnr = \frac{(D-Dv)\cdot\sin(180-\rho r)}{\sin(\rho r-\alpha r)} \qquad \text{Equation 4}$$

In addition, the corrected bevel apex position Pnt when the width Wnf is substantially equal to the width Wnr of the bevel slope Ynr can be obtained by the Equations 1, 2, 3, and 4 using the Dv satisfying the condition that Wnf=Wnr.

Next, a second method of setting the nose-side corrected bevel apex position Pnt will be described. The second setting method corresponds to a method in which particularly the appearance of the front bevel slope Ynf is seriously considered, where the width Wnf when viewing the front bevel slope Ynf is set to a predetermined value ΔW. The predetermined value ΔW is, for example, 0.6 mm. At this time, the Dv can be obtained by applying 0.6 mm to the Wnf in the Equations 1 and 2.

In addition, as a modified example of the second method of setting the corrected bevel apex position Pnt, a method of setting the width Wnf to be smaller than the width Wnr of the rear bevel slope (here, the value is not equal to "0") may be adopted. For example, the Dv is obtained so that the width Wnf becomes ½, ⅓, or the like of the width Wnr of the rear bevel slope.

Regarding the radial angle (edge position) of the target lens shape used for setting the nose-side corrected bevel apex position Pnt, the radial angle is located on the datum line DL of the target lens shape in the above description, but when the position of obtaining the good appearance of the nose-side bevel slope is located on the outside of the datum line DL, the radial angle may not be located thereon. For example, in the example of the target lens shape shown in FIG. 5B, the radial angle may be set at the position FD in an X-axis direction by the control unit 50 on the basis of the position FC (F1) which is the closest to the nose in the target lens shape or the optical center OC of the lens. Of course, the radial angle may be set at an arbitrary position on the target lens shape by an operator.

Next, a method of setting the ear-side corrected bevel apex position Pet will be described. The ear-side corrected bevel apex position Pet is located closer to the lens rear surface than the distance Dv from the ear-side edge position Pef on the side of the lens front surface to the nose-side corrected bevel apex position Pnt. As a method of setting the ear-side corrected bevel apex position Pet, the following method can be adopted. In addition, it is desirable that the radial angle (edge position) of the target lens shape used for setting the corrected bevel apex position Pet is located on the datum line DL in the same manner as the nose-side corrected bevel apex position Pnt. That is, the ear-side corrected bevel apex position Pet is set at a position opposite to the nose-side bevel apex position Pnt by 180° about the lens chuck center. In addition, in the case where the nose-side corrected bevel apex position Pnt is set at the positions FC and FD on the target lens shape in FIG. 5B, the ear-side corrected bevel apex position Pet may be set at a position opposite to the nose-side corrected bevel apex position Pnt by 180° about the y axis or the processing center.

As shown in FIG. 7A, a first method is to set a shift amount of the ear-side corrected bevel apex position Pet in accordance with a distance Δd in which the nose-side corrected bevel apex position Pnt changes relative to the position of the initially set bevel locus YC1. That is, the shift amount of the ear-side corrected bevel apex position Pet is set in accordance with the tilt angle β of the frame. For example, the shift amount is set to be equal to or twice larger than the distance Δd. In the case where the shift amount is equal to the distance Δd, the ear-side corrected bevel apex position Pet is set at the same position of the initially set ear-side bevel locus YC1. In the case where the shift amount is twice larger than the distance Δd, the ear-side corrected bevel apex position Pet is set at a position shifted from the ear-side bevel locus YC1 to the lens rear surface as much as the distance Δd. In addition, the first method includes the case where the bevel curve is tilted about the perpendicular reference line passing through a certain point N1 on the initially set first bevel locus YC1. It is desirable that the perpendicular reference line passing through the point N1 is a perpendicular line passing through the optical center of the lens or the geometric center of the target lens shape.

As shown in FIG. 7B, a second method is to set the ear-side corrected bevel apex position Pet as a position shifted from the ear-side edge position Pef on the side of the lens front surface to the lens rear surface by a predetermined amount de (for example, 1 mm) more than the distance Dv from the edge position of the lens front surface to the nose-side corrected bevel apex position Pnt. Accordingly, in the second method, it is possible to improve an appearance of the lens front surface compared with the prior art by suppressing a protrusion amount on the side of the lens front surface when viewed from the side of the lens.

In FIG. 7B, a third method is to set the ear-side corrected bevel apex position Pet by determining the shift amount de on the basis of the distance Dv in accordance with the ear-side edge thickness D. For example, the ear-side corrected bevel apex position Pet is set at a position in which the ear-side edge thickness D (or the edge thickness obtained by subtracting the distance Dv from the edge thickness D) is divided by a predetermined ratio (4:6 or the like). Accordingly, in the third method, it is possible to improve an appearance of the lens front surface compared with the prior art by disposing a protrusion amount in the lens front surface and the lens rear surface when viewed from the side of the lens.

The first to third methods described above are used to prevent the width Wer of the bevel slope on the side of the lens rear surface from appearing to be excessively large. In the case of the high curve frame, when the bevel is set in the same manner as the low curve frame, the ear-side bevel slope on the side of the lens rear surface tends to appear to be larger than that on the side of the lens front surface. In the first to third methods described above, it is possible to reduce such a problem.

As shown in FIG. 7C, a fourth method is to set the ear-side corrected bevel apex Pet so that the width Wef of the front bevel slope Yef is substantially equal to the width Wer of the rear bevel slope Yer when the lens is viewed from the front side (in a direction of the arrow BY) in the state where the wearer wears the eyeglass frame in the same manner as the first method of setting the nose-side corrected bevel apex position Pnt. As the method of calculating the ear-side corrected bevel apex position Pet in which the width Wef is equal to the width Wer, basically the same method as the calculation method of the nose-side corrected bevel apex position Pnt may be adopted. Accordingly, even in the case of the ear-side corrected bevel apex position Pet, it is possible to improve an appearance of the lens since the width Wer of the rear bevel slope can be hidden by the width Wef of the front bevel slope and the width Wef can be made small. The fourth method may be desirably used for a lens having a thin edge thickness such as a sunglass lens.

Figure 9:
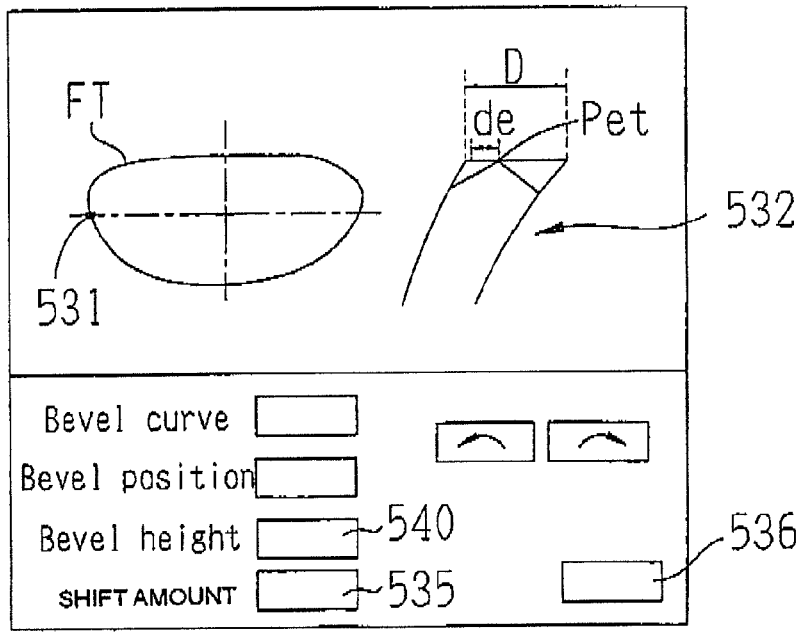
FIG. 9 is an example of a bevel simulation screen.

In the first to fourth methods, the ear-side corrected bevel apex position Pet is automatically calculated and set by the control unit 50. On the contrary, the fifth method is to set the ear-side corrected bevel apex Pet on the basis of the shift amount de in FIG. 7 input by an operator. For example, when the bevel simulation screen in FIG. 9 is selected, a lens sectional FIG. 532 at the ear-side edge position is displayed on the display 5. In addition, the edge position of the lens sectional FIG. 532 can be designated by manipulating a predetermined switch so as to move a cursor 531 on a target lens shape figure FT. The shift amount de is set by inputting a desired value into a shift amount input box 535, and the ear-side corrected bevel apex position Pet on the lens sectional shape 532 is changed.

When the high curve beveling mode is selected, the first and second methods of the nose-side corrected bevel apex position Pnt and the first to fifth methods of the ear-side corrected bevel apex position Pet may be set by means of a switch 536 displayed on the simulation screen.

When the nose-side corrected bevel apex position Pnt and the ear-side corrected bevel apex position Pet are set as described above, the bevel locus passing through the two points is calculated by the control unit 50. That is, the control unit 50 sets the second (corrected) bevel locus YC2 by tilting the bevel curve so as to pass through the nose-side corrected bevel apex position Pnt and the ear-side corrected bevel apex position Pet and by calculating the bevel apex position in a direction of the edge thickness for each radial angle of the target lens shape while maintaining the bevel curve of the initially set bevel locus YC1 suitable for the high curve frame. The bevel formation state using the bevel locus YC2 can be checked for each radial angle by means of the bevel simulation screen in FIG. 9.

After the bevel simulation screen is checked, when the processing start switch of the switch unit 7 is pressed, the peripheral edge of the lens LE is processed. First, the carriage 101 moves so that the lens LE is located at the position of the plastic roughing grindstone 166, and the Y-axis movement motor 150 is controlled by the roughing control data based on the target lens shape data, thereby performing the roughing process on the peripheral edge of the lens LE.

Next, a beveling process is carried out. In the case where the high curve beveling mode is selected, the bevel slope on the side of the lens front surface and the bevel slope on the side of the lens rear surface are respectively processed by the front surface beveling grindstone 163F and the rear surface beveling grindstone 163Rs. First, the carriage 101 moves so that the lens LE is located at the position of the front surface beveling grindstone 163F, the X-axis movement motor 145 and the Y-axis movement motor 150 controlled to be driven in accordance with the front surface beveling control data obtained on the basis of the bevel apex locus data, and then the bevel slope is processed on the lens front surface by the front surface beveling grindstone 163F while rotating the lens LE. Subsequently, the lens LE moves so as to be located to the position of the rear surface beveling grindstone 163Rs, the X-axis movement motor 145 and the Y-axis movement motor 150 are controlled to be driven in accordance with the rear surface beveling control data, and then the bevel slope is processed on the lens rear surface by the rear surface beveling grindstone 163Rs while rotating the lens LE. When the mode of forming the bevel shoulder on the lens rear surface is selected, the movement of the lens LE is controlled so that the bevel bottom Vbr is located at the intersection point 163G between the rear surface beveling grindstone 163Rs and the rear-surface-bevel shoulder processing slope 163Rk (see FIG. 3). Accordingly, even in the case of the high curve lens having an eight curve as a curve value of the lens, it is possible to form the bevel in which the bevel peak is small and the processing interference is suppressed. In addition, since the calculation of the processing control data of the front surface bevel slope of the grindstone 163F and the processing control data of the rear surface bevel slope of the grindstone 163Rs and the processing operation thereof may be carried out by the basic technique disclosed in JP-A-H11-48113 (U.S. Pat. No. 6,089,957), the description thereof will be omitted.

Further, in the above-described embodiment, the grindstone is used as the beveling tool, but the cutter or the end mill disclosed in JP-A-2001-47309 and JP-A-2006-281367 may be used.

Furthermore, in the above-described embodiment, an example of the eyeglass lens processing apparatus mainly used in an eyeglass shop is described. However, the present invention may be applied to the eyeglass lens processing apparatus installed in a laboratory processing center in which the eyeglass lens is mainly processed. In this case, the target lens shape data, the eyeglass frame tilt information, and the like measured by the eyeglass frame shape measuring unit 2 installed in the eyeglass shop may be desirably transmitted to the laboratory processing center by means of a communication.

What is claimed is:

1. An eyeglass lens processing apparatus for beveling a peripheral edge of an eyeglass lens by a beveling tool, the eyeglass lens processing apparatus comprising:

an edge position detector which detects a front edge position and a rear edge position of the lens on the basis of a target lens shape;

a mode selector which shifts a processing mode to a high curve processing mode for a high curve frame;

a bevel locus setting unit which includes:

a) a provisional bevel locus calculator which obtains a provisional bevel locus by obtaining a bevel curve substantially equal to a curve along the frame or a curve along a front surface of the lens when the high curve processing mode is selected;

b) a nose-side bevel position determining unit which determines a corrected bevel apex position at a nose-side edge position of the lens by setting a width of a front bevel slope, ox obtaining a nose-side bevel apex position in which the width of the front bevel slope is substantially equal to or smaller than a width of a rear bevel slope;

c) an ear-side bevel position determining unit which determines a corrected bevel apex position at an ear-side edge position of the lens by setting a position in which an ear-side bevel apex position on the provisional bevel locus is shifted to a rear surface of the lens, or obtaining a position in which a predetermined positional relationship between the ear-side bevel apex position and the nose-side corrected bevel apex position is satisfied; and d) a corrected bevel locus calculator which obtains a corrected bevel locus which has a curve value equal to a value of the bevel curve and passes through the nose-side corrected bevel apex position and the ear-side corrected bevel apex position; and a controller which obtains beveling data based on the corrected bevel locus and controls an operation of the apparatus according to the beveling data.

2. The eyeglass lens processing apparatus according to claim 1, further comprising:

a tilt angle input unit which is used to input a tilt angle of the frame, wherein the nose-side bevel position determining unit determines the nose-side corrected bevel apex position at a position in which the width of the front bevel slope is equal to a predetermined value smaller than the width of the rear bevel slope, a position in which the width of the front bevel slope is smaller by a predetermined ratio than the width of the rear bevel slope, or a position in which the width of the front bevel slope is substantially equal to the width of the rear bevel slope when the frame is viewed from the front side thereof on the basis of the input tilt angle and the edge position.

3. The eyeglass lens processing apparatus according to claim 1, wherein the ear-side bevel position determining unit determines the ear-side corrected bevel apex position by a method which shifts the ear-side bevel apex position on the provisional bevel locus to the rear surface by a fixed amount, a method which shifts the ear-side bevel apex position on the provisional bevel locus to the rear surface in accordance with a distance in which the nose-side corrected bevel apex position changes relative to the nose-side bevel apex position on the provisional bevel locus, a method which shifts the ear-side bevel apex position on the provisional bevel locus to a position obtained by dividing an edge thickness at the ear-side edge position at a predetermined ratio, or a method which shifts the ear-side bevel apex position on the provisional bevel locus to the rear surface by an input amount.

4. The eyeglass lens processing apparatus according to claim 1, further comprising:

a tilt angle input unit which is used to input a tilt angle of the frame, wherein the ear-side bevel position determines unit determines the ear-side corrected bevel apex position by a method which shifts the bevel apex position on the provisional bevel lens to the rear surface in accordance with the input tilt angle, or a method which shifts the ear-side bevel apex position on the provisional bevel locus to a position in which the width of the front bevel slope is substantially equal to the width of the rear bevel slope when the frame is viewed from the front side thereof on the basis of the input tilt angle.

5. The eyeglass lens processing apparatus according to claim 1, wherein the ear-side bevel position determines unit determines the ear-side edge position used to determine the ear-side corrected bevel apex position at a position which is located on a horizontal line passing through a geometric center of the target lens shape, at a position which is opposite to the edge position having the nose-side corrected bevel apex-position by 180° about a lens chuck center, or at a position which is opposite to the edge position having the nose-side corrected bevel apex position by 180° about a perpendicular line passing through the geometric center of the target lens shape.

* * * * *